US005973584A

United States Patent [19]

Goseberg

[11] Patent Number: 5,973,584

[45] Date of Patent: Oct. 26, 1999

[54] HIGH-VOLTAGE TRANSFORMER FOR A TELEVISION RECEIVER

[75] Inventor: Walter Goseberg, Hannover, Germany

[73] Assignee: Deutsche Thomson-Brandt GmbH, Villingen-Schwenningen, Germany

[21] Appl. No.: 08/753,356

[22] Filed: Nov. 25, 1996

[30] Foreign Application Priority Data

Dec. 1, 1995 [DE] Germany ..... 195 44 900

[51] Int. Cl.[6] ..... H01F 27/30; H01F 27/28

[52] U.S. Cl. ..... 336/206; 336/185; 336/198; 336/180

[58] Field of Search ..... 336/206, 180, 336/170, 182, 220, 198, 208, 185

[56] References Cited

U.S. PATENT DOCUMENTS

| | | | |
|---|---|---|---|
| 4,229,786 | 10/1980 | Mitani et al. | 363/126 |
| 4,780,696 | 10/1988 | Jirka | 336/170 |
| 4,857,877 | 8/1989 | Dethienne | 336/170 |
| 5,400,005 | 3/1995 | Bobry | 336/165 |
| 5,404,123 | 4/1995 | Joseph | 336/206 |

FOREIGN PATENT DOCUMENTS 4320714 1/1995 Germany ..... H01F 38/42

OTHER PUBLICATIONS

Fujimura, Maruyama, Umehara, Power Supply for Color TV Receivers In: IEEE–Trans. Consumer Electronics, 1978, S.477.

Copy of Search Report, date Feb. 1996.

*Primary Examiner*—Michael L. Gellner
*Assistant Examiner*—Anh Mai
*Attorney, Agent, or Firm*—Joseph S. Tripoli; Frederick A. Wein; Daniel E. Sragow

[57] ABSTRACT

There is disclosed a high voltage transformer for a television receiver, comprising a coil former in which there are situated auxiliary windings, a primary winding over the auxiliary windings, and a high voltage winding over the primary winding. A first sleeve forms a flat base for the primary winding, and is arranged on the auxiliary windings. The primary winding is wound from a plurality of layers of solid wire, each layer disposed directly over the other, and a further sleeve made of a dielectric inserted between two of the plurality of layers.

4 Claims, 2 Drawing Sheets

| | a | b | c | d |
|---|---|---|---|---|
| f / kHz | L / mH | R / Ω | L / mH | R / Ω |
| 0 | 0 | 0.25 | 0 | 0.25 |
| 10 | 1.3 | 0.3 | 1.3 | 0.3 |
| 20 | 1.32 | 0.5 | 1.32 | 0.45 |
| 40 | 1.38 | 0.88 | 1.36 | 0.65 |
| 100 | 1.6 | 2 | 1.45 | 1 |
| 400 | ∞ Res. | 40 | 3 | 4 |

HIGH-VOLTAGE TRANSFORMER FOR A TELEVISION RECEIVER

BACKGROUND OF THE INVENTION

The invention is based on a high-voltage transformer for a television receiver. In the case of a transformer of this type, it is known to wind the primary winding with a multiple-stranded wire. The use of multiple-stranded wire for the primary winding is necessary in order to keep the so-called skin losses sufficiently low, in particular at relatively high line frequencies of 32 kHz. However, a primary winding made of multiple-stranded wire is more expensive than a solid wire by a factor approximately of 7 and has disadvantages during the winding operation, during soldering and when being fastened to the connection pins of the transformer.

SUMMARY OF THE INVENTION

The invention is based on the object of designing a high-voltage transformer of this type in such a way that solid wire can be used instead of multiple-stranded wire for the primary winding and, nevertheless, the requirements in respect of coupling, copper losses and skin losses are satisfied. This object is achieved by means of the invention specified. Advantageous developments of the invention are specified in the subclaims.

According to the invention, then, the primary winding is wound from a plurality of layers of solid wire lying one above the other, and a sleeve made of a dielectric is inserted between each two layers.

To date, it has been assumed that the use of multiple-stranded wire is essential for the primary winding of the high-voltage transformer owing to the skin losses which otherwise occur, in particular at an elevated line frequency of 32 kHz. The solution according to the invention is based on the following insights and considerations: The winding capacitance of the primary winding is considerably reduced by inserting the sleeve between two layers of the primary winding lying one above the other. Consequently, the capacitive reactive currents also become correspondingly smaller. Since reactive currents are the main cause of skin losses, the reduction in the winding capacitance causes the skin losses which occur at the primary winding to become correspondingly lower. The reduction in the skin losses therefore makes it possible, surprisingly, to use a solid wire instead of a multiple-stranded wire for the primary winding even at relatively high frequencies of 32 kHz. The relatively cheap sleeve between two layers of the primary winding therefore renders the previously necessary, expensive multiple-stranded wire for the primary winding unnecessary. It may inherently be assumed that the transformer coupling is reduced by the insertion of the sleeve. However, it has been shown that this is not the case. This is due to the fact that the radial distance over which the primary winding extends is practically unincreased compared with known transformers as a result of the individual layers, in other words the to some extent flattened primary winding. As a result, good coupling between the primary winding and the high-voltage winding is still ensured.

Overall, the invention yields the following advantages. The costs of the transformer become significantly lower, because the primary winding has the relatively expensive multiple-stranded wire replaced by the solid wire, which is cheaper by a factor of 7. Despite this, good transformer coupling is achieved because the solution according to the invention permits a structure which is narrow in the radial direction. The low copper losses and the low skin losses also lead to a reduction in the heating of the transformer. The solid wire instead of the multiple-stranded wire additionally has the advantage that it can be soldered better and more rapidly during production. The winding operation and the capability of winding the wire ends on the connection pins of the transformer are also significantly improved.

The primary winding preferably consists of two layers with a copper wire insulated by two enamel layers, a so-called CuEE wire, between which the sleeve having a wall thickness of the order of magnitude of 0.4 to 0.8 mm is inserted. The individual layers of the primary winding are in this case preferably designed as a bifilar winding with two wires lying next to one another. In other words, two wires are continually wound in parallel at the same time.

It is also possible to wind a first layer of the primary winding directly over the auxiliary windings without the interposition of a sleeve. This is particularly advantageous when the first layer only has a small number of turns.

The sleeve is preferably produced as a cylindrical plastic injection moulding having a wall thickness of 0.4 to 0.8 mm. The sleeve is slit in the longitudinal direction at one point on its circumference and can be placed onto the coil former by being widened in the radial direction. The sleeve can also consist of a plurality of film layers or of paper.

In a preferred embodiment of the invention, the length L of the coil former in the axial direction is significantly less than the external diameter D of the entire coil former for auxiliary windings, primary winding and high-voltage winding, that is to say the ratio L/D is appreciably less than 1. A structure of this type enables costs and weight to be reduced, particularly for the ferrite core.

BRIEF DESCRIPTION OF THE DRAWINGS

The invention is explained below with reference to the wing, in which

FIG. 1 shows the core limb 1 of the core of the high-voltage transformer. The core is preferably designed as a U/U core, as an E/I core or as a U/I core. The coil former 2 is arranged on the core limb 1. Situated on the bottom of the coil former 2 are, first of all, a plurality of auxiliary windings 3, for example for generating operating voltages, pulse voltages or for heating the picture tube. The auxiliary windings 3 have a non-uniform surface. For this reason, the sleeve 4 made of a dielectric and having a wall thickness of, for example, 0.4 to 0.8 mm is arranged over the auxiliary windings 3 and forms a smooth base for the primary winding. The first primary winding element P1 is arranged first in the form of a layer on the sleeve 4. The winding element P1 is wound in a bifilar manner with a CuEE wire having a diameter of 2×0.45 mm. A further sleeve 5 lies on the winding element P1. The second primary winding element P2, which is connected in series with the winding element P1, lies over the sleeve 5. The sleeve 5 effects, in the manner described, the reduction in the winding capacitance of the complete winding P1, P2 and, as a result, the advantages which have been outlined. The coil former 2 is surrounded by the chamber-type coil former 6, in whose chambers 7 the high-voltage winding 8 is situated.

FIG. 2 shows the advantages achieved by the transformer according to FIG. 1. Columns a and b show the inductance L and the non-reactive resistance R of the primary winding P as a function of the frequency f for a known transformer. It is evident that the values of L and R increase considerably as the frequency f increases. The frequencies f shown are present in practice as a result of harmonics in the current of the primary winding P1 which occur particularly in a transformer at an elevated line frequency of 32 kHz. The pronounced increase in L and R as the frequency f increases leads to the production of considerable copper and skin losses in the transformer.

DETAILED DESCRIPTION OF INVENTION

Figures 1, 2:
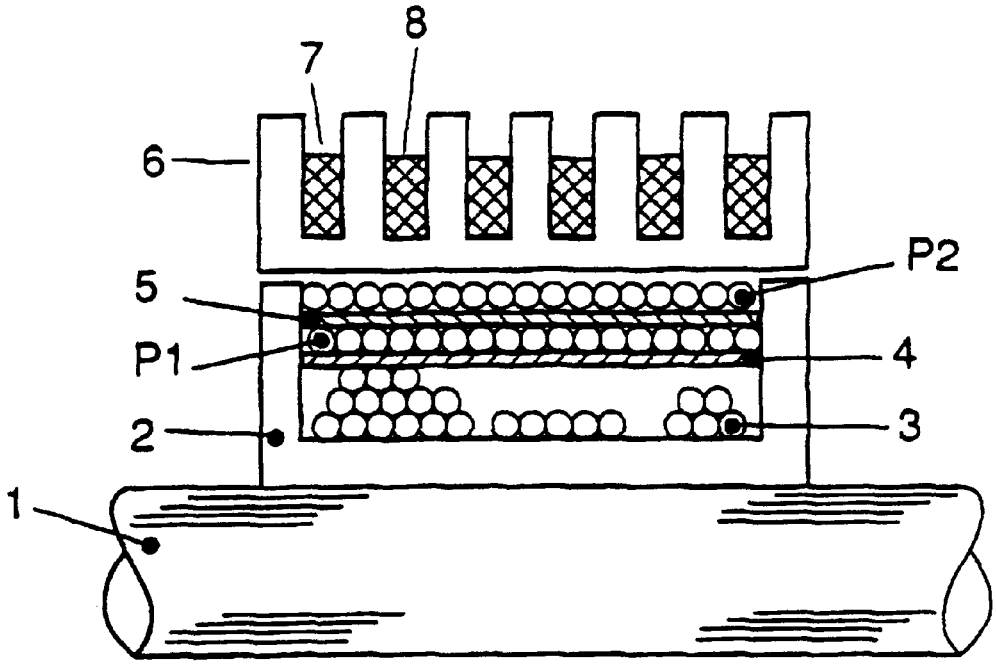
FIG. 1 shows the structure of the high-voltage transformer according to the invention.
FIG. 2 shows values of the inductance and of the nonreactive resistance of the primary winding of this transformer as a function of the frequency.

Columns c and d in FIG. 2 show the values of L and R for a transformer according to FIG. 1. It is evident that the values of L and R increase , in a desirable manner, significantly less with the frequency f than in the case of the known transformer as revealed in columns a and b. Consequently, the copper and skin losses in the transformer are considerably reduced because of these reduced values of L and R, in particular at relatively high frequencies, with the result that it is now possible, in the manner described, to use a significantly cheaper solid wire for the primary winding P instead of multiple-stranded wire.

Figure 3:
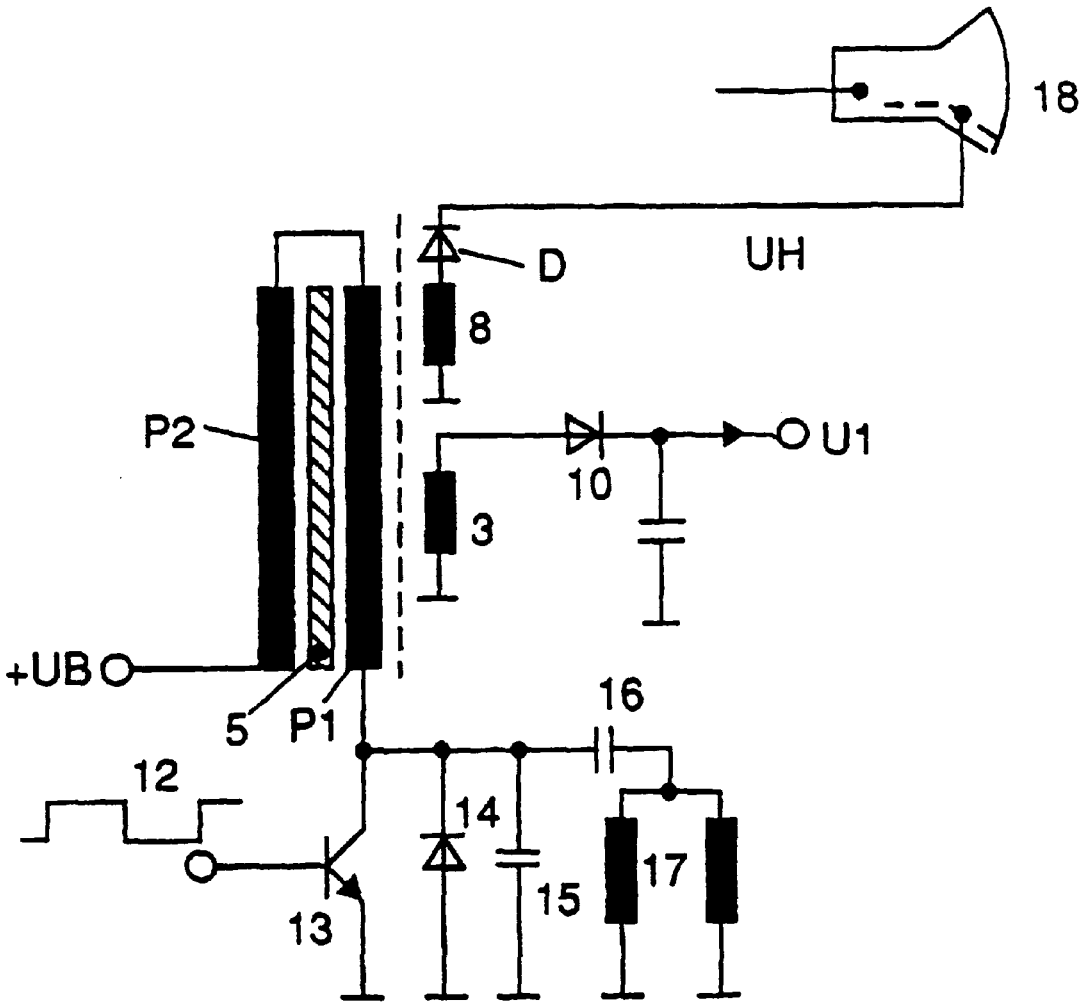
FIG. 3 shows the circuit of a line output stage with high-voltage generation using a transformer according to FIG. 1.

FIG. 3 shows a line deflection circuit with the high voltage being obtained using a transformer having the structure according to FIG. 1. This figure shows the switching transistor 13, which is controlled by the line-frequency switching voltage 12, the flyback diode 14, the flyback capacitor 15, the coupling or tangent capacitor 16, the line deflection coils 17, the primary winding connected to an operating voltage UB and having the series-connected primary winding elements P1 and P2 according to FIG. 1, an auxiliary winding 3, which generates an operating voltage U1 via the rectifier circuit 10, and the high-voltage winding 8, which generates the high voltage UH for the picture tube 18 via the high-voltage rectifier D. In accordance with FIG. 1, the sleeve 5 is arranged between the primary winding elements P1 and P2.

I claim:

1. High-voltage transformer for a television receiver comprising:

a coil former in which there are disposed auxiliary windings, a primary winding disposed over the auxiliary windings and a high-voltage winding disposed over the primary winding, a first sleeve, which forms a flat base for the primary winding, being arranged between the auxiliary windings and the primary winding, wherein the primary winding is wound from a plurality of layers of solid wire lying directly one over the other, and a second sleeve made of a dielectric is inserted between two of said primary layers to reduce the winding capacitance of said primary winding, and a second coil former disposed about the first coil former with the primary winding, with the second coil former being disposed about the high voltage winding.

2. Transformer according to claim 1 wherein the layers of the primary winding are formed by bifilar windings.

3. Transformer according to claim 1, wherein the second sleeve is produced as a plastic injection molding having a wall thickness of approximately 0.4 mm to 0.8 mm.

4. Transformer according to claim 1, wherein the further sleeve (5) comprises a plurality of film layers or paper.

* * * * *